United States Patent [19]

Theissen et al.

[11] Patent Number: 4,816,758

[45] Date of Patent: Mar. 28, 1989

[54] METHOD AND APPARATUS FOR THE DETECTION OF SLAG CO-FLOWING WITHIN A STREAM OF MOLTEN METAL

[75] Inventors: Wolfgang Theissen, Wurselen; Edmund Julius, Aachen; Franz R. Block, Roetgen, all of Fed. Rep. of Germany

[73] Assignee: AMEPA Angewandte Messtechnik und Prozessautomatisierung GmbH, Aachen, Fed. Rep. of Germany

[21] Appl. No.: 890,193

[22] PCT Filed: Oct. 17, 1985

[86] PCT No.: PCT/EP85/00544

§ 371 Date: Jun. 24, 1986

§ 102(e) Date: Jun. 24, 1986

[87] PCT Pub. No.: WO86/02583

PCT Pub. Date: May 9, 1986

[30] Foreign Application Priority Data

Oct. 27, 1984 [DE] Fed. Rep. of Germany ..... 3439369

[51] Int. Cl.[4] ..... G01N 27/74; G01N 27/72; G01R 33/12

[52] U.S. Cl. ..... 324/204; 324/232; 324/226; 324/243

[58] Field of Search ..... 324/204, 232, 226, 234, 324/235, 239, 243; 73/290 R; 164/451, 452, 453, 454, 4.1

[56] References Cited

U.S. PATENT DOCUMENTS 4,279,149 7/1981 Block ..... 73/290 R
4,529,029 7/1985 Block ..... 164/453

FOREIGN PATENT DOCUMENTS 57-121864 7/1982 Japan .

*Primary Examiner*—Reinhard J. Eisenzopf
*Assistant Examiner*—Walter E. Snow
*Attorney, Agent, or Firm*—Wenderoth, Lind & Ponack

[57] ABSTRACT

A method and an apparatus for the detection of slag co-flowing within a stream of molten steel being poured from metallurgical vessel, more particularly during continuous casting, makes it possible to detect even a small quantity of slag in the emerging flow of molten metal without requiring the removal of the shielding for the pouring stream, or without interfering with the pouring, by measuring changes in the electrical conductivity of the pouring system by means of electromagnetic fields. To this end, one or more transmitter coils and receiver coils are mounted fixedly around the pouring stream. The transmitter coils are fed with a current containing several frequencies, and the magnitude and phase position of the voltage induced in the receiver coils are evaluated frequency-selectively so as to increase the sensitivity, the measuring transducer being operated in a bridge circuit. The change in electrical conductivity of the pouring stream and, hence, the quantity of slag, are determined from the magnitude and phase position of the voltage induced in the measuring coils. Temperature-dependent errors are largely suppressed.

24 Claims, 4 Drawing Sheets

METHOD AND APPARATUS FOR THE DETECTION OF SLAG CO-FLOWING WITHIN A STREAM OF MOLTEN METAL

BACKGROUND OF THE INVENTION

The present invention relates to a method and an apparatus for the detection of slag co-flowing within a stream of molten metal, more particularly, in molten steels as they are being poured from metallurgical vessels.

As steel is being poured from converters, ladles or tundishes, a layer of slag lies on the surface of the molten metal. For metallurgical reasons, an effort is made to pour out as little slag as possible. In general, the following methods for preventing the outflow of slag are known:

In a ladle, the approximate point in time at which the slag can flow out is determined. For this purpose, the ladle is weighed in its empty and full state in order to determine the amount of molten metal remaining in each case. After the reading on the scale indicates that the amount of material has dropped to critical levels, the outflow of slag is determined visually by the operating personnel.

Aside from the fact that the detection of the remaining quantity of molten metal can be determined only very imprecisely, since it depends on the degree of erosion of the ladle lining, this method is cumbersome, especially if the pouring is done under a protective gas, which is generally the case with high-grade steels. This is because part of the shielding needs to be removed so that the pouring stream can be observed. This requires a considerable effort in terms of mechanical engineering and is also detrimental to quality.

In another method, visual monitoring is eliminated, the pouring being discontinued when a certain filling level in the ladle is reached.

This method is uneconomical, because a residue of molten metal always remains in the ladle and later needs to be melted down.

SUMMARY OF THE INVENTION

Therefore, the invention has for its object the provision of a method by which the presence of a small quantity of slag in the molten metal flowing out can be detected and displayed without requiring the removal of the shielding for the pouring stream, or interference with the pouring.

The temperatures of the molten metal and of the measuring transducers must be continually monitored. Temperature measurements are old in the art. This determination is particularly simple if from the ohmic resistances of coils one can assess the temperatures of the measuring transducers and, hence, the temperature of the molten metal. Heat propagation in the system itself can be calculated once the material characteristics have been determined in the usual manner.

The value of the electrical conductivity, which is used to calculate the distribution of the slag from the measured values of the voltage spectrum, can be corrected with the measured temperature values.

By using a reference setup likewise consisting of a transmitter coil and a receiver coil, the two transmitter coils being series-connected and the two receiver coils being inverse-parallel, the sensitivity can be increased considerably.

Another embodiment of the invention provides for an additional winding on the transmitter coil of the reference setup, to which a current which varies in magnitude and phase position is applied frequency-selectively, so that the the total voltage of the receiver coil becomes or approximates zero for all frequencies.

Therefore, to further reduce the effect of temperature, another embodiment of the invention provides for the use of a coil arrangement coaxially surrounding the flow section and consisting of two transmitter coils and one receiver coil, which are spaced a radial distance from each other, or for the operation of a coil arrangement in such a way that the axes of the transmitter and receiver coils are arranged radially around the test item with the same radial distance from the test item and the transmitter coils lie outside the base corners of an isosceles triangle, the voltage induced in the receiver coil being adjusted to zero by appropriate feeding of the currents to the transmitter coil.

Preferably, the signals from the measuring coils are measured by means of phase-sensitive rectifiers, and the evaluation and adjustment of the bridge circuits are carried out with a computer or microprocessor.

An apparatus for carrying out the method according to the invention can, for example, be used in a metallurgical vessel provided with a lining, the transmitter and receiver coils for the measuring transducer being incorporated into the lining or into perforated bricks of the vessel.

According to one design of the apparatus of the invention, both the transmitter and receiver coils and a reference transmitter coil are incorporated into the lining or in perforated bricks of the vessel.

Finally, according to another design of the apparatus of the invention, the vessel can be provided with an outlet valve controlled by means of the measured values detected.

Therefore, according to the method of the invention, one or more transmitter and receiver coils can be fixedly mounted around the emerging pouring stream such that they surround the latter, preferably in a coaxial direction. With this design, the transmitter coils are fed with a current containing several frequencies, during which the magnitude and phase position of the voltage induced in the receiver coils are measured frequency-selectively. The proportion of slag in the molten metal can be assessed by means of a computer or microprocessor from the radial distribution of the electrical conductivity.

To increase its sensitivity, a bridge circuit can be used in which a reference setup consisting of a transmitter and a receiver coil is connected such that the transmitter coils carry the same supply current, while the receiver coils are so connected that the induced voltages run in directions opposite to one another.

In order to adjust the bridge circuit and to further increase its sensitivity, an additional winding is placed on the reference coil, which is fed with a current whose phase positions and magnitudes change frequency-selectively at the same frequency as the supply current. By means of this compensation current, the measuring bridge is adjusted such that the total voltage of the individual frequencies across the receiver coils become zero. Changes in the electrical conductivity of the test item then lead to the frequency-selective detuning of the zero balance of the bridge.

The transmitter coils may be fed with currents containing several frequencies and the magnitudes and phase positions thereof adjusted frequency-selectively in relation to each other, so that the induced voltage in the measuring coil is adjusted to zero for all frequencies. Changes in the electrical conductivity of the test item then produce a frequency-selective detuning of the zero balance of the bridge.

With this method of the invention, the presence of a quantity of slag in the pouring stream can be detected as follows:

Since the electrical conductivity of the molten steel is considerably higher than that of the slag, a quantity of slag in the pouring stream lowers the local electrical conductivity. Changes in the electrical conductivity of the test item alter the magnitudes and phase positions of the induced eddy currents and hence of the voltage induced in the receiving coils. Changes in the diameter of the test item produce signals which can be distinguished, in terms of magnitude and phase position, from the signals which are generated as a result of variations in conductivity.

By using several frequencies of the supply current with resultant electromagnetic fields with different depths of penetration, additional information is obtained as to the local radial distribution of the electrical conductivity and the geometry of the test item. As a result, the resolution can be increased further, so that even a very small quantity of slag can be detected in the pouring stream.

Errors resulting from variations in the temperature of the molten metal and of the measuring transducers are sensed, and the measured values used to calculate the slag content are corrected accordingly.

DESCRIPTION OF THE PREFERRED EMBODIMENTS

Figure 1A:
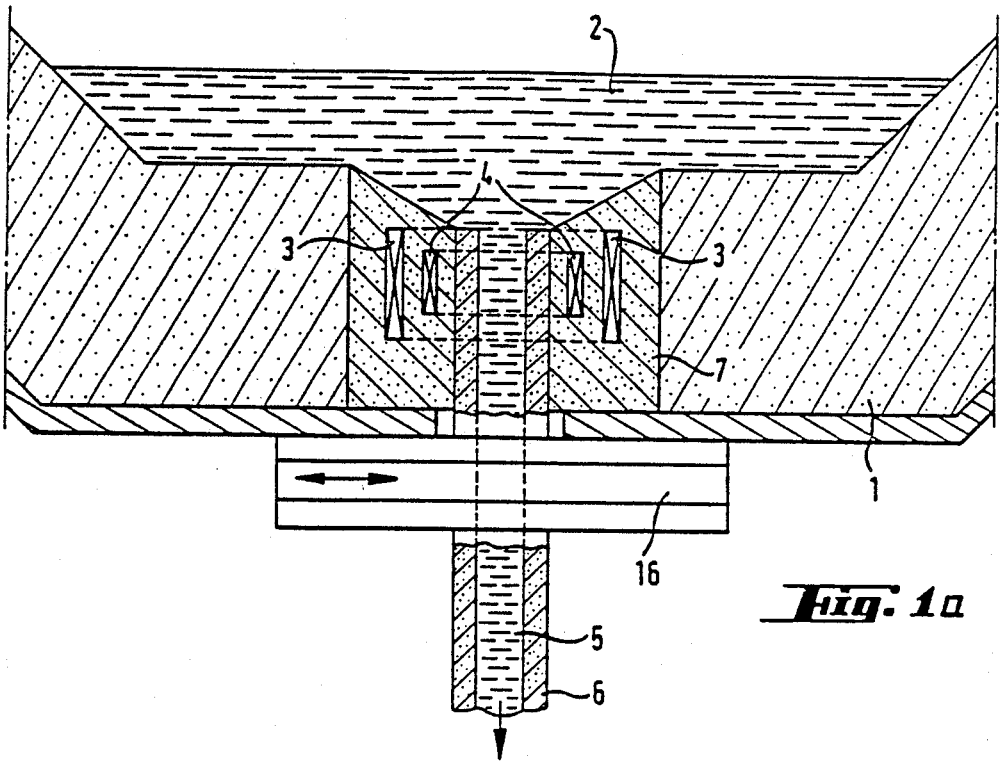
FIG. 1*a* shows the measuring transducers physically installed in a perforated brick in a ladle or tundish.

In FIG. 1*a*, a metallurgical vessel is designated 1, a heat of molten metal 2, a transmitter coil 3, a receiver coil 4, a pouring stream 5, an outlet pipe 6, a perforated brick 7, and an outlet valve 16.

The transmitter coil 3 surrounds the pouring stream 5 and generates the primary field. The receiver coil 4 is located coaxially inside the transmitter coil 3. The two coils 3 and 4 are embedded and cast into the perforated brick 7.

Figure 1B:
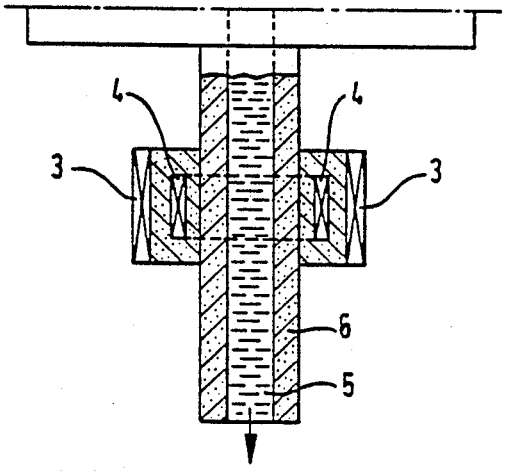
FIG. 1*b* shows the measuring transducer physically installed on the surface of an outlet pipe in a ladle or tundish.

FIG. 1*b* shows an example of how the measuring transducer surrounds the outlet pipe 6 from a ladle and tundish.

The transmitter coil 3 and receiver coil 4 are fixedly connected to each other and coaxially surround the outlet pipe 6. The transmitter coil and receiver coil are fastened to the outlet pipe, such that, when the outlet pipe 6 is being replaced, they can easily be removed and reused.

If the measuring setup is operated in a bridge circuit to increase its sensitivity, the reference setup consists of a transmitter and receiver coil arranged such that a substantially identical induction voltage is generated in the reference receiver coil as in the measuring circuit.

Figure 2:
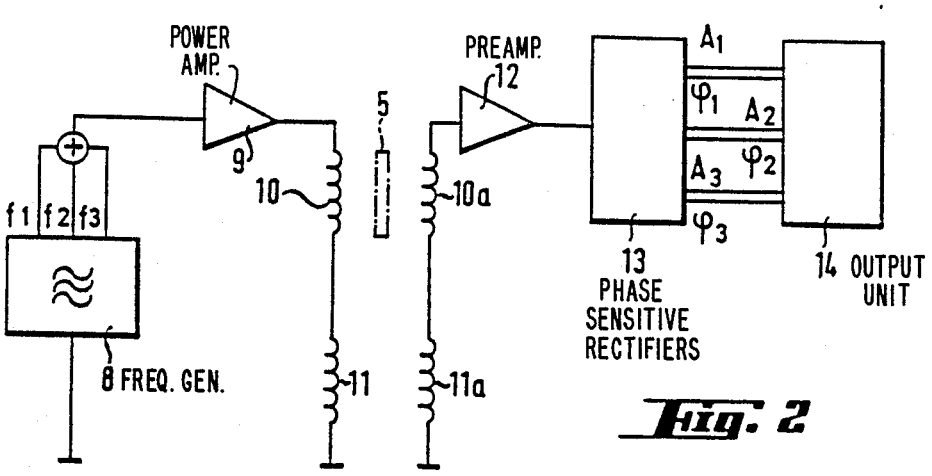
FIG. 2 shows a measuring circuit for three frequencies in which the transducers and reference setup are operated as a bridge circuit.

FIG. 2 shows the basic layout of a measuring circuit for three frequencies, in which the transducer and reference arrangements are operated in a bridge circuit.

A frequency generator 8 feeds a power amplifier 9 having three frequencies and feeding the series-connected transmitter coil 10 of the measuring transducer and one transmitter coil 11 of the reference arrangement. One receiver coil 10*a* of the measuring transducer and one receiver coil 11*a* of the reference arrangement are connected in an inverse-parallel fashion and designed such that the induced voltages almost compensate for one another. The composite signal is routed via a high-resistance preamplifier 12 to the phase-sensitive rectifiers 13 which break down the signal into real and imaginary components, which are displayed on an appropriate output unit 14.

Figure 3:
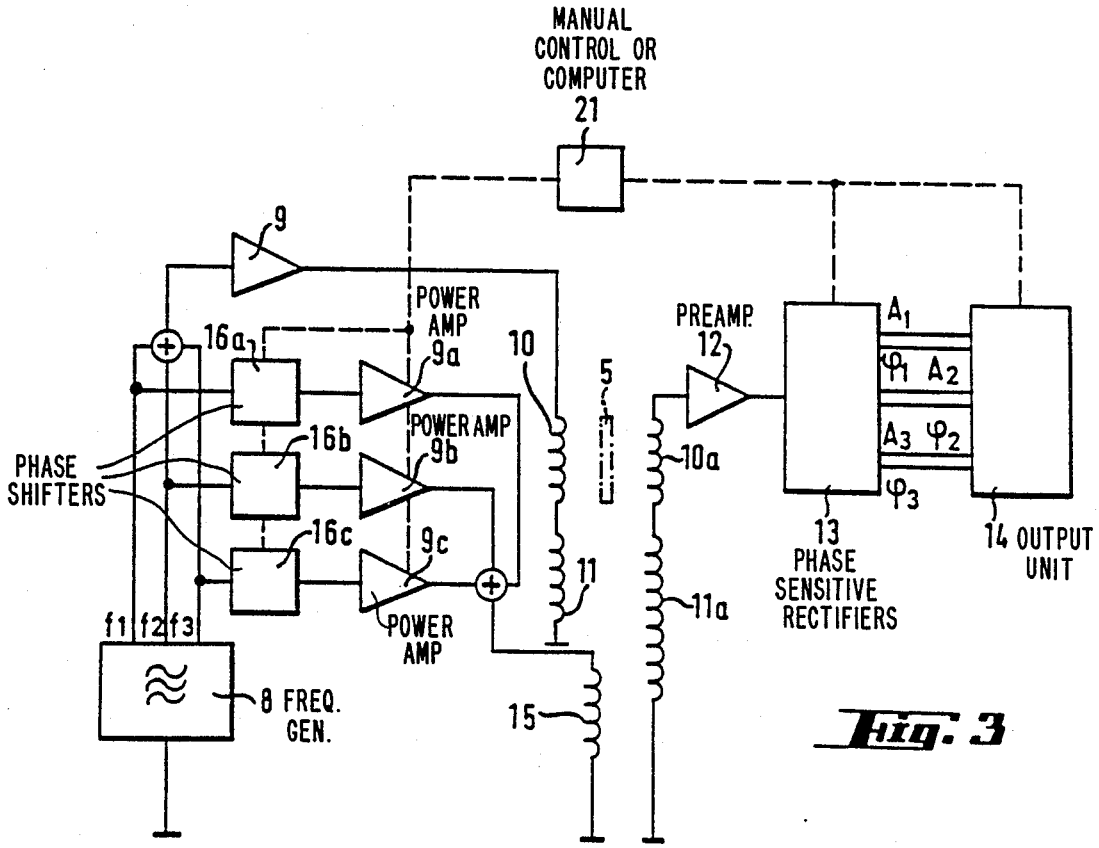
FIG. 3 shows a measuring circuit for three frequencies with a compensation winding, in which the measuring bridge is balanced by means of a compensation current.

FIG. 3 shows the basic layout of a measuring circuit for three frequencies, in which the measuring transducer and the reference arrangement are operated in a bridge circuit and the bridge balance is effected by means of a compensation current.

The measuring and reference setup is operated as in FIG. 2. In addition, a compensation winding 15 operated as an extra transmitter coil is attached to the reference coil setup. The signal picked off at the frequency generator 8 is fed frequency-selectively through adjustable phase shifters 16*a*, 16*b* and 16*c* to the power amplifiers 9*a*, 9*b* and 9*c* which feed the compensation winding and the gain of which can also be altered.

The phase positions and magnitudes of the compensation currents are so adjusted, either manually or by means of a computer or microprocessor 21, such that the total voltage at the input of the preamplifier 12 is zero for all frequencies. Changes in the conductivity of the test item will then result in the detuning of the composite field and in a composite signal at the input of the preamplifier 12, from the magnitudes and phase positions of which the radial distribution of the electrical conductivity of the pouring stream 5 and, hence, the quantity of slag can be determined.

Figure 4A:
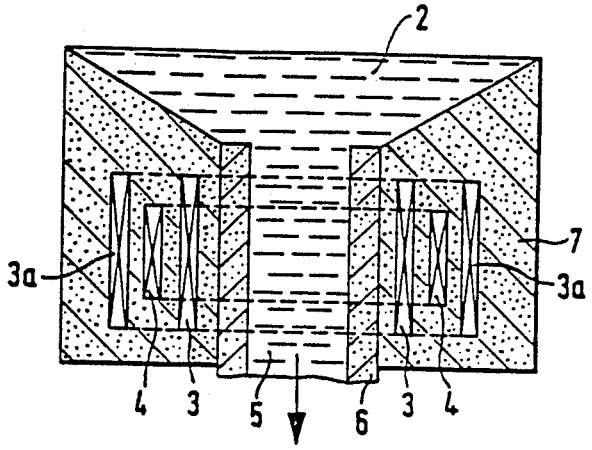
FIG. 4*a* shows the physical layout of a measuring transducer consisting of two transmitter coils and one receiver coil, and in which the coils of the measuring transducer coaxially surround the flow section of the molten metal.

FIG. 4*a* shows the basic physical layout of a measuring transducer consisting of two transmitter coils 3, 3*a* and one receiver coil 4. In this case, the transmitter coil 3 is coaxially surrounded by the receiver coil 4 at a certain radial distance the optimum value of which depends on the overall geometry of the measuring transducer, and the latter is itself surrounded by the second transmitter coil 3*a*, which acts as a reference coil. These coils are arranged to be physically fixed in relation to each other, preferably cast in, and again, as a result, surround the pouring stream 5 at a predetermined distance.

Figure 4B:
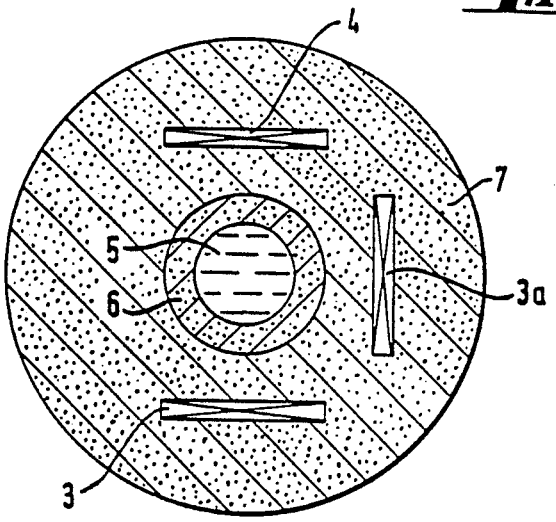
FIG. 4*b* shows the physical layout of a measuring transducer consisting of two transmitter coils and one receiver coil in which the axes of the measuring-transducer coils point in a radial direction.

FIG. 4b shows the basic mechanical layout of a measuring transducer consisting of two transmitter coils 3, 3a and one receiver coil 4. The transmitter coils 3, 3a and the receiver coil 4 are arranged such that their axes point in a radial direction, and the transmitter coil 3a and transmitter coil 3 are mutually displaced by 180° in relation to the receiver coil 4.

Figure 5:
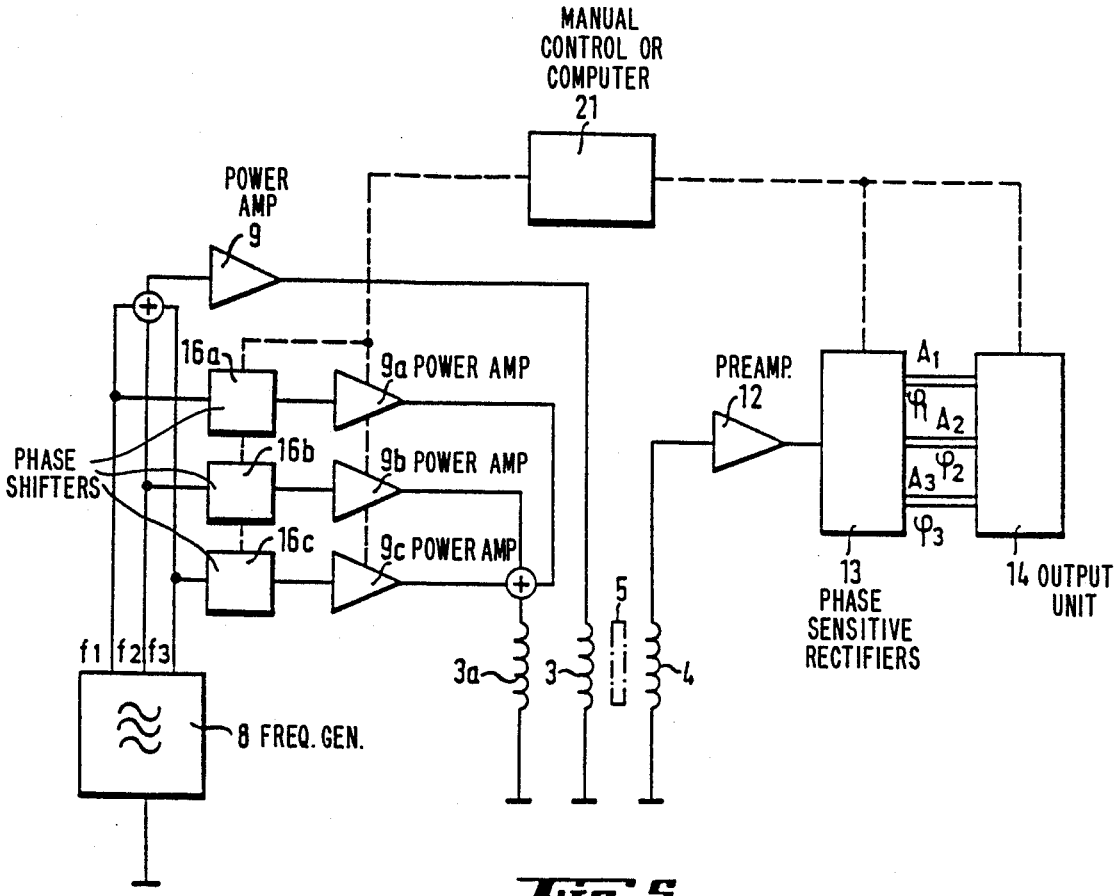
FIG. 5 shows the measuring circuit depicted in FIGS. 4*a* and 4*b*, the bridge balance being effected by means of the supply current.

FIG. 5 shows the basic layout for a measuring circuit for three frequencies having the coil arrangement shown in FIG. 4a or 4b as the measuring transducer. A frequency generator 8 drives a power amplifier with three frequencies, which itself feeds the transmitter coil 3 of the measuring transducer. At the same time, the signal from the frequency generator 8 is fed frequency-selectively via adjustable phase shifters 16a, 16b and 16c to the power amplifiers 9a, 9b and 9c, which power the transmitter coil 3a of the measuring transducer. The voltage induced in the receiver coil 4 of the measuring transducer is fed by means of a preamplifier 12 to the phase-sensitive rectifiers 13, which break the signal down frequency-selectively into real and imaginary components, which are displayed on an appropriate output unit 14.

The phase positions of the compensation currents in the transmitter coil 3a are adjusted such by means of the phase shifters 16a, 16b and 16c, and the magnitudes thereof by means of the gain factors of the power amplifiers 9a, 9b and 9c, that the induction voltage present at the input of the preamplifier 12 becomes zero for all frequencies.

Changes in the radial distribution of the electrical conductivity in the test item 5 lead to a detuning of the measuring bridge and to a signal at the input of the preamplifier 12, from the magnitudes and phase positions of which the radial distribution of the electrical conductivity and, hence, the quantity of slag in the pouring stream can be determined. The balancing of the measuring bridge can be carried out either manually or by means of a microprocessor 21.

We claim:

1. A method for the detecting of the proportions of slag co-flowing within a stream of molten metal comprising the steps of:

(a) arranging two series connected transmitter coils so as to surround a flow section of the slag co-flowing with the stream of molten metal;

(b) arranging two series connected receiver coils so as to also surround the flow section;

(c) supplying a current containing a plurality of frequencies to the transmitter coils, the current inducing a voltage in the receiver coils;

(d) processing the induced voltage at the plurality of frequencies to produce output signals corresponding to each of the plurality of frequencies; and (e) detecting the proportions of slag co-flowing within the stream of molten metal in accordance with the output signals.

2. A method as recited in claim 1, further comprising the step of:

(a) arranging another transmitter coil so as to surround the flow section;

(b) selectively supplying another current containing the plurality of frequencies to the another transmitter coil so as to also induce a voltage in the receiver coils, and (c) controlling the amplitude and phase of current components of the another current at the plurality of frequencies in accordance with the output signals.

3. A method for the detection of the properties of slag co-flowing within a stream of molten metal comprising the steps of:

(a) arranging first and second transmitter coils and one receiver coil so as to surround a flow section of the slag co-flowing with the stream of molten metal;

(b) supplying a first current containing a plurality of frequencies to the first transmitter coil, the current inducing a voltage in the receiver coil;

(c) selectively supplying a second current containing the plurality of frequencies to the second transmitter coil so as to also induce a voltage in the receiving coil;

(d) processing the induced voltages at the plurality of frequencies to produce output signals corresponding to each of the plurality of frequencies;

(e) controlling the amplitude and phase of current components of the second current at the plurality of frequencies in accordance with the output signals; and (f) detecting the proportion of slag co-flowing within the stream of molten metal in accordance with the output signals.

4. A method as recited in claim 1, wherein the transmitter coils and receiver coils are arranged coaxially and the coils are spaced a given radial distance from each other.

5. A method as recited in claim 2, wherein the transmitter coils and receiver coils are arranged coaxially and the coils are spaced a given radial distance from each other.

6. A method as recited in claim 3, wherein the transmitter coils and receiver coil are arranged coaxially and the coils are spaced a given radial distance from each other.

7. A method as recited in claim 1, wherein the coils are disposed into a lining or perforated bricks of a vessel containing molten metal and slag from which the stream is drawn.

8. A method as recited in claim 2, wherein the coils are disposed into a lining or perforated bricks of a vessel containing molten metal and slag from which the stream is drawn.

9. A method as recited in claim 3, wherein the coils are disposed into a lining or perforated bricks of a vessel containing molten metal and slag from which the stream is drawn.

10. A method as recited in claim 4, wherein the coils are disposed into a lining or perforated bricks of a vessel containing molten metal and slag from which the stream is drawn.

11. A method as recited in claim 5, wherein the coils are disposed into a lining or perforated bricks of a vessel containing molten metal and slag from which the stream is drawn.

12. A method as recited in claim 6, wherein the coils are disposed into a lining or perforated bricks of a vessel containing molten metal and slag from which the stream is drawn.

13. An apparatus for the detection of the proportion of slag co-flowing within a stream of molten metal comprising:

(a) two series connected transmitter coils arranged so as to surround a flow section of the slag co-flowing with the stream of molten metal;

(b) two series connected receiver coils arranged so as to also surround said flow section;

(c) a current generator circuit for supplying a current containing a plurality of frequencies to said transmitter coils, said current inducing a voltage in said receiver coils;

(d) a means for processing the induced voltage at the plurality of frequencies to produce output signals corresponding to each of the plurality of frequencies;

(e) and a means for detecting the proportion of slag co-flowing within the stream of molten metal in accordance with said output signals.

14. An apparatus as recited in claim 13, further comprising:

(a) another transmitter coil disposed so as to surround said flow section;

(b) a current means for supplying another current containing said plurality of frequencies to said another transmitter coil so as to also induce a voltage in said receiver coils, and (c) a controlling means for controlling the amplitude and phase of current components of said another current at said plurality of frequencies in accordance with said output signals.

15. An apparatus for the detection of the proportion of slag co-flowing within a stream of molten metal comprising:

(a) first and second transmitter coils and one receiver coil, said coils arranged so as to surround a flow section of said slag co-flowing with the stream of molten metal;

(b) a current means for supplying a first current containing a plurality of frequencies to said first transmitter coil, said current inducing a voltage in said receiver coil;

(c) a means for selectively supplying a second current containing said plurality of frequencies to said second transmitter coil so as to also induce a voltage in said receiving coil;

(d) a means for processing said induced voltages at said plurality of frequencies so as to produce output signals corresponding to each of said plurality of frequencies;

(e) a controlling means for controlling the amplitude and phase of current components of said second current at said plurality of frequencies in accordance with said output signals; and (f) a means for detecting the proportion of slag co-flowing within said stream of molten metal in accordance with said output signals.

16. An apparatus as recited in claim 13, wherein said transmitter coils and receiver coils are arranged coaxially and are spaced a given radial distance from each other.

17. An apparatus as recited in claim 14, wherein said transmitter coils and receiver coils are arranged coaxially and are spaced a given radial distance from each other.

18. An apparatus as recited in claim 15, wherein said transmitter coils and receiver coil are arranged coaxially and are spaced a given radial distance from each other.

19. An apparatus as recited in claim 13, wherein said coils are disposed into a lining or perforated bricks of a vessel containing said molten metal and slag from which said stream is drawn.

20. An apparatus as recited in claim 14, wherein said coils are disposed into a lining or perforated bricks of a vessel containing said molten metal and slag from which said stream is drawn.

21. An apparatus as recited in claim 15, wherein said coils are disposed into a lining or perforated bricks of a vessel containing said molten metal and slag from which said stream is drawn.

22. An apparatus as recited in claim 16, wherein said coils are disposed into a lining or perforated bricks of a vessel containing said molten metal and slag from which said stream is drawn.

23. An apparatus as recited in claim 17, wherein said coils are disposed into a lining or perforated bricks of a vessel containing said molten metal and slag from which said stream is drawn.

24. An apparatus as recited in claim 18, wherein said coils are disposed into a lining or perforated bricks of a vessel containing said molten metal and slag from which said stream is drawn.

* * * * *